United States Patent [19]

Kaye et al.

[11] Patent Number: 5,016,749

[45] Date of Patent: May 21, 1991

[54] EYEGLASS AND CONTACT LENS HOLDER

[76] Inventors: Kenneth Kaye; Barbara Kaye, both of 310 E. Lincoln Ave., Cranford, N.J. 07016

[21] Appl. No.: 529,604

[22] Filed: May 29, 1990

[51] Int. Cl.[5] ..... B65D 85/38

[52] U.S. Cl. ..... 206/5.1; 206/5; 206/6

[58] Field of Search ..... 206/5, 5.1, 6, 38

[56] References Cited

U.S. PATENT DOCUMENTS

| | | | |
|---|---|---|---|
| 1,834,419 | 12/1931 | Pratt | 206/5 |
| 1,842,925 | 1/1932 | Willmott | 206/5 |
| 2,735,597 | 2/1956 | Treleven | 206/5 |
| 3,124,240 | 3/1964 | Croan | 206/5 |
| 3,323,638 | 6/1967 | Dishart | 206/5 |
| 3,825,110 | 7/1974 | Halbich et al. | 206/6 |
| 4,865,186 | 9/1989 | Gates | 206/5.1 |

FOREIGN PATENT DOCUMENTS

| | | | |
|---|---|---|---|
| 1176698 | 4/1959 | France | 206/5.1 |
| 0452258 | 8/1936 | United Kingdom | 206/6 |

*Primary Examiner*—Jimmy G. Foster
*Attorney, Agent, or Firm*—Arthur L. Plevy

[57] ABSTRACT

A device for simultaneously carrying spectacles and contact lenses which includes a hollow open base for containing the spectacles, the base further containing a contact lens case secured to an interior surface thereof for containing a pair of contact lenses. A lid is hingedly connected to the base for covering the opening therein and may support a mirror affixed thereto to assist in installing or removing the contact lenses.

12 Claims, 2 Drawing Sheets

EYEGLASS AND CONTACT LENS HOLDER

BACKGROUND OF THE INVENTION

1. Field of the Invention

The present invention relates to an eyeglass case, and more particularly to an eyeglass case having a receptacle for containing contact lenses.

2. Description of Related Art

A variety of types of cases for containing eyeglasses are known. Of these, certain dual-function eyeglass cases existing in the art may have some tangential general relevance to the present invention. Of interest are U.S. Pat. Nos. 683,417 to Weinstein, 1,004,474 to Schnorr, 1,649,255 to Robinson, and 3,000,417 to Goldstein, each of which teaches a case for containing two pairs of eyeglasses. Similarly, of general interest is U.S. Pat. No. 3,323,638 to Dishart which teaches an eyeglass case for containing a pair of spectacles, a nail file, a comb, a nail clipper, and a magnifying glass. While eyeglasses and cases for storing them have been in use for centuries, contact lenses have a shorter history, having come into general use in the 1960's. Contact lenses have rapidly grown in popularity as technology has produced more comfortable and affordable lenses and many previous eyeglass wearers now use contact lenses. Despite technological advances, contact lenses still exhibit certain disadvantages, such as, limited oxygen permeability and a propensity to become dirty and infected with bacteria. It is therefore common for a contact lens wearer to remove their lenses periodically for cleaning and/or to give their eyes a rest from the intrusion of irritating contact lenses. A backup pair of eyeglasses is usually employed to correct vision while the contacts are removed. Thus, cases for storing and carrying contact lens have become quite common. Of these, the ordinary dual cup contact lens case having a pair of lens cups with threaded or snap on lids and affixed to a base plate appears most relevant to the present invention. While numerous designs presently exist for eyeglass and contact lens cases, the prior art does not reveal an eyeglass case suitable for simultaneously carrying contact lens.

SUMMARY OF THE INVENTION

The problems and disadvantages associated with the conventional techniques and devices utilized to carry eyeglasses and contact lenses are overcome by the present invention which includes a carrying case for simultaneously carrying spectacles and contact lenses. The case has a hollow open base for containing the spectacles and further contains a contact lens case secured to an interior surface of the base where contact lenses may be stored. A lid is hingedly connected to the base for covering the open portion thereof.

BRIEF DESCRIPTION OF THE FIGURES

For a better understanding of the present invention, reference is made to the following detailed description of an exemplary embodiment considered in conjunction with the accompanying drawings, in which.

DESCRIPTION OF THE PREFERRED EMBODIMENTS

Figure 1:
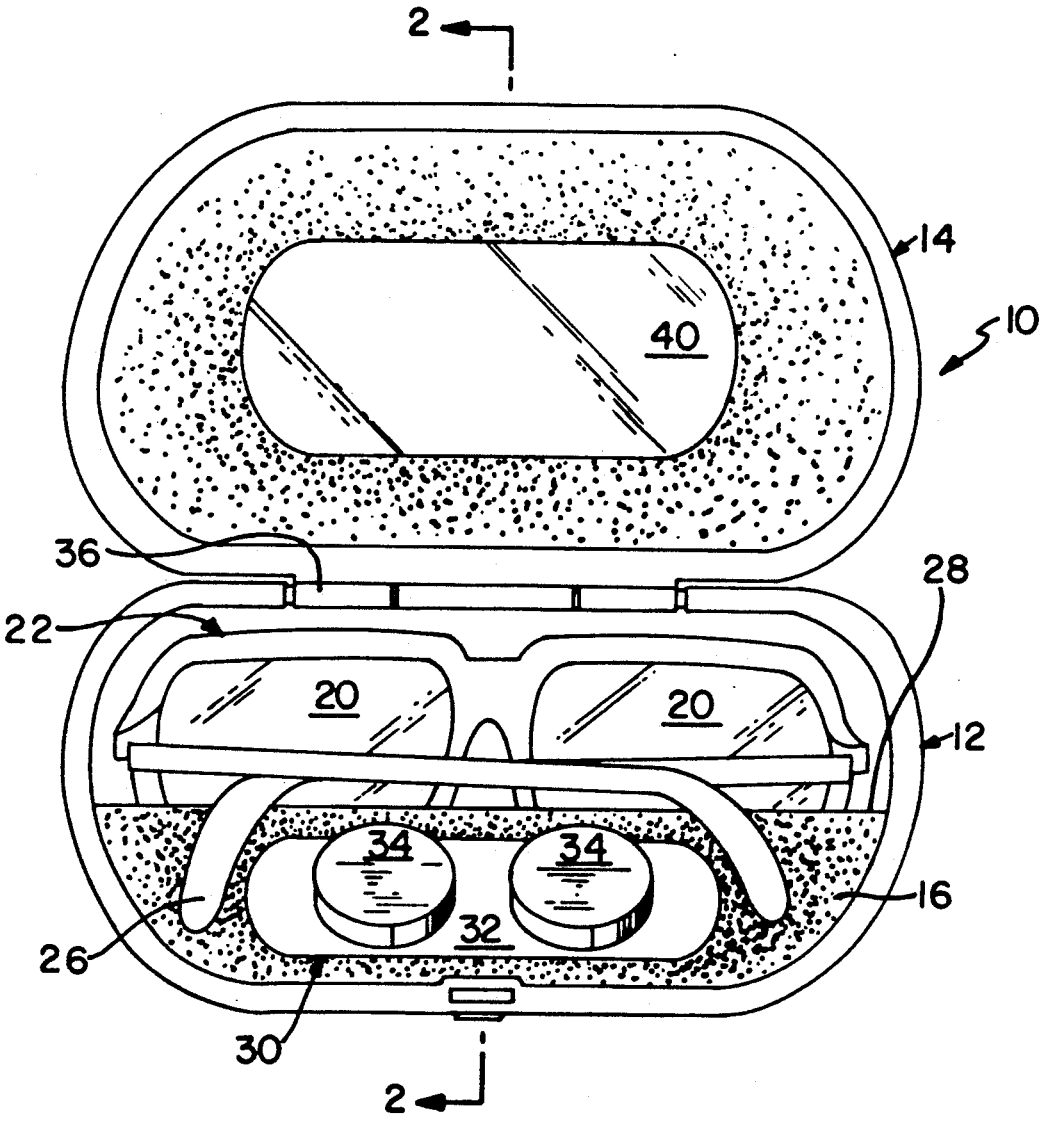
FIG. 1 is a perspective view of a eyeglass case constructed in accordance with an exemplary embodiment of the present invention.

Referring to FIG. 1 there is shown an eyeglass or spectacle case 10 with a clamshell-like construction having a bottom receptacle 12 and a lid 14. The bottom receptacle 12 is divided by a partial partition 16 disposed at an intermediate depth and covering approximately one-half of the open area of the receptacle 12. The partition defines a posterior open chamber 18 for receiving the lens and frame assembly 20 of a set of spectacles 22, and an anterior chamber 24, partially delimited by the lid 14 when closed, for receiving the earhorns 26 of the spectacles 22 (see FIG. 2). The spacing of the partition 16 from the back wall 28 of the receptacle 12 should approximate the thickness of the lens and frame assembly 20 of the spectacles 22 that are stored therein to prevent them from rattling around in the case. The case 10 is preferably formed from an injection molded plastic, however, other materials such as compressed fibrous matter, e.g, cardboard, could be employed. The partition 16 could be manufactured from the same materials as the case or from another material and can either be a snap or press fit into the bottom receptacle 12 or glued or melt welded onto the receptacle 12. It would be possible to construct the partition 16 from a fabric or flexible film, such as vinyl, as well. The entire interior of the case 10 may be lined with a soft, shock absorbing, non-abrasive material such as foam covered with velvet or felt to prevent the spectacles 22 from being scratched or broken.

A contact lens case 30 having a base 32 and a pair of lens cups 34 marked for storage of left and right contact lens is affixed to the partition 16 by gluing or through other conventional means, such as, plastic welding. The lens case 30 is situated on the partition 16 at a location that does not interfere with the folding and storage of the earhorns 26 of the spectacles 22. Although a conventional contact lens case 30, which is glued to the partition 16, is shown and described, it is likely that for large production runs it would be more efficient to eliminate the base 32 of the lens case 30 and affix the lens cups 34 directly to the partition 16 or mold the entire assembly in a single step. It is also possible to removably retain the contact lens case 30 within the glasses case 10 via, e.g., Velcro R material or by other temporary retaining means and in this manner the contact case could be used apart from the glasses case. The lens cups 34 are conventional, being merely small cups having an interior concavity matching the curvature of the typical contact lens and a screw-on or snap on lid making a fluid tight seal. The lid 14 is attached by hinges 36 or by a living hinge to the bottom receptacle 12 and a latch mechanism 38 is provided for maintaining closure. The present invention includes a mirror 40 affixed by gluing or other conventional means to the interior of the lid 14. The mirror 40 is provided for the purpose of allowing the user to observe their efforts in installing or removing the contact lenses.

Figure 2:
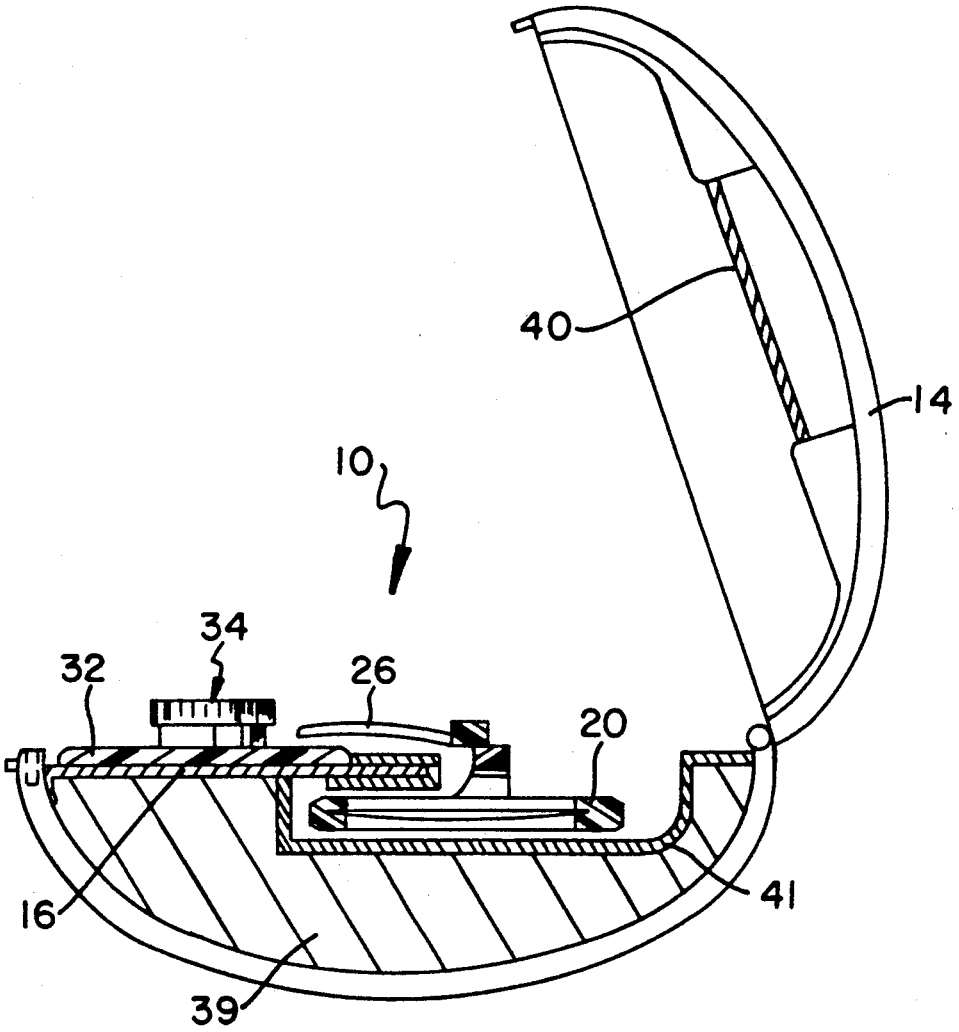
FIG. 2 is a cross-sectional view of the device depicted in FIG. 1 taken along line II—II and looking in the direction of the arrows.

Referring now to FIG. 2 wherein a cross-sectional view of the device of FIG. is shown, the relative vertical positions of the aforementioned components can be appreciated. A shock absorbing foam insert 39 and non-abrasive lining material 41 are visible in this view.

Figure 3:
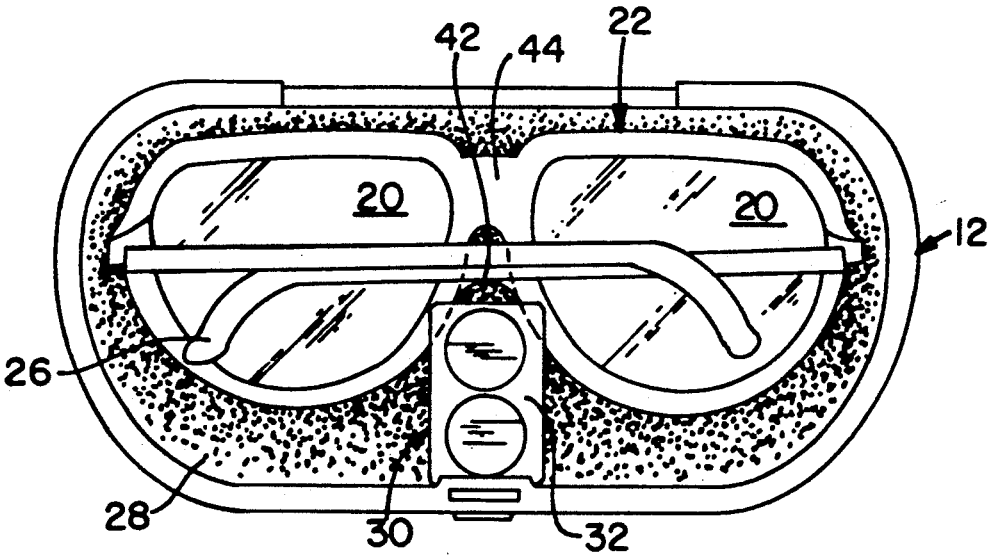
FIG. 3 is a plan view of the bottom portion of an alternative exemplary embodiment of an eyeglass case constructed in accordance with the present invention.

Referring to FIG. 3, the receptacle 12 of an alternative exemplary embodiment of the present invention is shown. In this embodiment, the partition 16 is eliminated as the means for retaining the spectacles 22 in position in the bottom receptacle 12. The contact lens case 30 is affixed to the back wall 28 of the bottom receptacle 12 by a plinth 42 which spaces the base 32 of the lens case 30 away from the back wall 28 at a distance that approximates the thickness of the lens and frame assembly 20 of the spectacles 22 in the area of the nose bridge 44. The plinth 42 can be shaped complementary to the nose bridge 44 thereby providing enhanced registration of the spectacles 22 with the plinth 42. The base 32 thus captures the spectacles 22 between itself and the backwall 28 preventing vertical movement, the plinth 42 preventing horizontal movement.

Thus it should be appreciated that the present invention provides an inexpensive and reliable device for simultaneously carrying a pair of spectacles and a pair of contact lenses. The contact lens wearer is well served by the present invention in that, if an irritant finds its way into their eye when wearing contact lenses, they can remove the contact lenses aided by the mirror 40, store them in the lens case 30 provided, and substitute a pair of spectacles 22 carried within the case 10.

It should be understood that the embodiments described herein are merely exemplary and that a person skilled in the art may make many variations and modifications without departing from the spirit and scope of the invention as defined in the appended claims.

I claim:

1. A carrying case for spectacles and contact lenses which comprises:

(a) a hollow open base for containing said spectacles;

(b) a partial partition affixed to the interior of said hollow base which divides said base into an open anterior and an open posterior compartment, said posterior compartment receiving the lens frame portion of said spectacles and said anterior compartment accommodating the earhorns of said spectacles;

(c) a pair of contact lens cups affixed to the surface of said partition facing said anterior compartment, said lens cups for holding at least a pair of contact lenses in a liquid solution;

(d) a lid hingedly connected to said base for covering said open base.

2. The device of claim 1, further comprising a mirror affixed to an interior surface of said lid.

3. The device of claim 2, further comprising a non-abrasive nappy material lining affixed to the interior of said case and to said partition for insulating said spectacles from shock and abrasion and for assisting in retaining said spectacles in a single position within said case, and a latch disposed on an edge of said lid for maintaining closure.

4. The device of claim 3, wherein said case and said partition are composed of an injection molded plastic.

5. The device of claim 1, wherein said lens case is affixed to said base by Velcro material.

6. The device of claim 5, wherein said lens cups are affixed to said partition by Velcro material.

7. A carrying case for spectacles and contact lenses which comprises:

(a) a hollow open base for containing said spectacles;

(b) a contact lens case secured to an interior surface of said base for containing said contact lenses;

(c) a plinth interposed between said base and said lens case for spacing said lens case away from said base a distance approximating the thickness of the lens frame portion of said spectacles whereby said lens frame portion is captured between said base and said lens case when said spectacles are stored in said case and wherein said plinth has a cross-sectional shape substantially complimentary to the shape of the nose bridge portion of said glasses whereby said nose bridge fits snugly over said plinth when said spectacles are stored in said case.

8. The device of claim 7, further comprising a mirror affixed to an interior surface of said lid.

9. The device of claim 8, further comprising a non-abrasive nappy material lining affixed to the interior of said case and said plinth for insulating said spectacles from shock and abrasion and for assisting in retaining said spectacles in a single position within said case and a latch disposed on an edge of said lid for maintaining closure.

10. The device of claim 9, wherein said case and said plinth are composed of an injection molded plastic.

11. A carrying case for spectacles and contact lenses which comprises:

(a) a hollow open base for containing said spectacles;

(b) a contact lens case secured to an interior surface of said base for containing said contact lenses;

(c) a plinth interposed between said base and said lens case for spacing said lens case away form said base a distance approximating the thickness of the lens frame portion of said spectacles whereby said lens frame portion is captured between said base and said lens case when said spectacles are stored in said case and wherein said lens case is removably affixed to said base.

12. The device of claim 11, wherein said lens case is affixed to said base by Velcro material.

* * * * *